US006564704B1

(12) United States Patent
Nies et al.

(10) Patent No.: US 6,564,704 B1
(45) Date of Patent: May 20, 2003

(54) PRESS WITH ECCENTRIC CRANK DRIVE FOR UPPER PUNCH UNIT, AND OPERATING METHOD

(75) Inventors: Norbert Nies, Neuss (DE); Matthias Holthausen, Wassenberg (DE); Bernd Horn, Leipzig (DE); Nikolaus Hoppenkamps, Mönchengladbach (DE)

(73) Assignee: SMS Demag AG, Düsseldorf (DE)

( * ) Notice: Subject to any disclaimer, the term of this patent is extended or adjusted under 35 U.S.C. 154(b) by 134 days.

(21) Appl. No.: 09/668,872

(22) Filed: Sep. 25, 2000

(30) Foreign Application Priority Data

Sep. 24, 1999 (DE) ..... 199 47 689

(51) Int. Cl.[7] ..... B30B 1/08

(52) U.S. Cl. ..... 100/270; 100/269.14; 100/282

(58) Field of Search ..... 100/35, 99, 269.01, 100/269.14, 270, 281, 282, 288, 52

(56) References Cited

U.S. PATENT DOCUMENTS

| | | | | | |
|---|---|---|---|---|---|
| 2,600,242 | A | * | 6/1952 | May | 100/231 |
| 2,784,665 | A | * | 3/1957 | Georgeff | 100/259 |
| 3,124,019 | A | * | 3/1964 | Chatfield | 100/281 |
| 4,195,564 | A | * | 4/1980 | Shiokawa | 100/231 |
| 4,434,646 | A | * | 3/1984 | Maeda et al. | 100/231 |
| 5,002,711 | A | * | 3/1991 | Iwama et al. | 100/918 |
| 5,346,381 | A | * | 9/1994 | Marcovecchio et al. | 100/51 |
| 5,669,257 | A | * | 9/1997 | Inoue et al. | 72/20.1 |

* cited by examiner

*Primary Examiner*—Allen Ostrager
*Assistant Examiner*—J Nguyen
(74) *Attorney, Agent, or Firm*—Cohen, Pontani, Lieberman & Pavane

(57) ABSTRACT

A press for pressing pulverulent materials, in particular metal powder, having an eccentric crank drive, which has at least one connecting rod and a crankshaft and a gearwheel which is connected thereto in a rotationally fixed manner, for driving an upper punch unit. It is possible to drive the gearwheel via at least one worm drive of at least one motor. An electronic control unit is also provided. In this press, the electronic control unit is designed for reversing operation of the crankshaft.

4 Claims, 2 Drawing Sheets

PRESS WITH ECCENTRIC CRANK DRIVE FOR UPPER PUNCH UNIT, AND OPERATING METHOD

BACKGROUND OF THE INVENTION

1. Field of the Invention

The invention relates to a press for pressing pulverulent materials, in particular metal powder, having an eccentric crank drive, which has at least one connecting rod and a crankshaft, for driving an upper punch unit. The invention further relates to a method for operating this press.

2. Discussion of the Prior Art

For many years, mechanical powder presses have been used in the technology of pressing metal and metal ceramic powders in order to produce powder compacts. These mechanical presses, which are usually designed as eccentric presses or toggle presses, are distinguished by a high working speed combined with a sinusoidal punch movement with a very progressive compressive force profile during the working cycle. To produce particularly complicated shaped parts, it is preferable to use powder presses whose press tools are moved by hydraulic piston/cylinder systems. In conjunction with corresponding electronic control units, the individual press tools can be optimally controlled, with regard to compressive force and pressing travel, in such a way that the compacts formed, despite their complicated shape, are distinguished by a density inside the shaped body volume which is as far as possible constant. Compared to mechanical presses, however, hydraulic presses generally present a lower working speed, i.e. longer cycle times, and consume considerably greater amounts of energy.

German reference DE 41 14 880 A1, which represents the generic prior art, discloses a press for pressing pulverulent materials which is designed as a mechanical eccentric press having an electric drive motor for moving the upper punch of the press. The crankshaft of the eccentric drive for the upper punch its connected in a rotationally fixed manner to a gearwheel which is moved by a worm drive which, for its part, is rotated by an electric motor. The direction of rotation of the electric motor and the crankshaft does not change during operation. A hydraulic piston/cylinder system is provided in order to move the die. The particular feature of this known press is that it has a coding switch which scans the working position of the upper punch and feeds a corresponding signal to the electronic control unit of this press. Furthermore, there is a frequency converter which acts on the electric drive motor and receives setting signals from the electronic control unit, so that the drive movement can be controlled. The upper punch is mounted in a pressure-measuring cylinder and can be displaced in the pressing direction. The hydraulic displacement of the upper punch is guided by the electronic press control unit. The intention of this combination of a mechanically driven eccentric press with additional hydraulic drives for press tools is that it should be possible to produce large numbers of powder compacts which are also of very good quality in terms of their shape, while ensuring constant dimensions and density of the compacts.

SUMMARY OF THE INVENTION

The object of the present invention is to refine a press of the generic type in such a way that the sinusoidal movement and progressive force profile which is known from mechanical presses and is advantageous for the compression of the powder is combined with the advantages which are brought about by a relatively simple hydraulic driving technology in terms of a high level of press flexibility and a pressing profile which is close to ideal together with a high level of reproducibility of speed and position of the press tools. The energy consumption by this press is to be low in relation to the drive forces which it is able to generate. The pressing parameters are to be easily adjustable in order to optimize the movement sequence and the power requirements. Furthermore, it is intended to provide a method for operating this press.

To drive its upper punch unit, the press according to the invention has an eccentric crank drive which comprises at least one connecting rod (usually arranged in pairs), which at one end is connected to the upper punch unit and at the other end is eccentrically connected to a crankshaft. The connection to the crankshaft may, for example, be produced by means of an eccentric disc. A gearwheel is connected to the crankshaft in a rotationally fixed manner. This gearwheel can be rotated by at least one, preferably by two, drive worms which are expediently situated diametrically opposite one another with respect to the crankshaft and for their part are driven by at least one motor, preferably are each driven by a separate motor. The movement sequences of this press are guided by an electronic control unit. The essential distinguishing feature of the invention is that this electronic control unit is designed for reversing operation of the crankshaft. The crankshaft is preferably rotated through an angular range of less than 180°. In accordance with the reversing rotation of the gearwheel, the force transmission through the connecting rod causes the upper punch unit to move up and down, i.e. to and from between the pressing position and the filling/ejection position. Unlike in conventional mechanical presses with an eccentric crank drive, in the case of the press according to the invention the crankshaft therefore does not execute complete revolutions.

Due to the particularly high torque density in relation to the volume and the relatively low flywheel effect $GD^2$ of hydraulic motors, which allow highly dynamic driving, hydraulic motors are preferred to the use of electric drive motors. The arrangement of two worm drives each with a separate drive motor allows the worm drive to generate torques on the crankshaft which are twice as high, with a relatively small volume, due to the force transmission ratio, without the tooth loads on the gearwheel or the worm drives increasing.

It is particularly expedient if the control unit is designed so that the preferably two hydraulic motors of the press can optionally be connected in parallel and in series in terms of the way in which they are connected into the circuit of the hydraulic medium. In the case of a parallel circuit, with two hydraulic motors, half the mass flow passes through each motor, while in the case of a series circuit the entire mass flow passes through each of the two motors. This offers the possibility, without changing the hydraulic unit, of setting a working speed which is standard or twice as high. The latter is very particularly advantageous in particular for pressing relatively small parts of low height.

Furthermore, it is advantageous if the press includes a die which can be displaced in a controlled manner by hydraulic cylinders in continuous-path control, as is fundamentally known for hydraulic presses. Furthermore, the press may comprise a hydraulically actuable tool adapter. For these cases, it is expedient to provide a central electric motor which drives a hydraulic pump for the upper punch unit and a further hydraulic pump for the hydraulic cylinders of the die and/or the hydraulically actuable tool adapter.

To determine the particular position of the upper punch unit, it is recommended to use electronic measuring systems for indirect or preferably direct determination. By way of example, it is possible to provide an electronic displacement-measuring system for recording the current position of the upper ram of the press, which holds the upper punch unit, or alternatively an electronic rotation angle transmitter for recording the current angular position of the crankshaft.

The particular advantage of the press according to the invention, the movements of whose press tool parts are guided by the electronic control unit, is that it is possible to directly influence the driving of the eccentric crankshaft, preferably by means of the flow of hydraulic medium, which is very easy to influence hydraulically using simple means with regard to its volumetric flow rate and pressure. Therefore, both the speed and the torque at the eccentric crank drive can be influenced very easily and accurately by hydraulic means. A further advantage is that the eccentric crankshaft results in a considerable transmission ratio with regard to the compressive force which can be generated by the press. Naturally, the compressive force required is greatest in the region of the top dead center of the upper punch unit. However, it is in this very position of the press that the transmission ratio between driving force and compressive force is also at its greatest. This means that the driving power required for the press drive can be selected to be significantly lower compared to a hydraulic press which has the same maximum compressive force. Consequently, the total energy consumption during a pressing cycle is also significantly lower.

The press according to the invention allows cycle times which are shorter than those of a continuous mechanical eccentric crank press which is driven in the usual way by an electric motor. This is possible if the press control unit is set in such a way that the stroke is terminated and then reversed in each case significantly before the top dead center of the eccentric crank drive is reached in a conventional mechanical press, this movement always has to be fully completed.

The cycle time of a conventional mechanical press is determined to a significant extent by the procedures required during removal of the compact. These include in particular the need to maintain a loading force while the die is being pulled away, this force being applied by a hydraulic piston/cylinder system accommodated in the upper punch drive unit. In continuous operation, this piston/cylinder system has to carry out an extension movement corresponding to the return movement of the upper punch drive unit in order to maintain the loading force and, after the die has been pulled away, has to be retracted into the starting position as quickly as possible. This requires either a particularly high-performance (expensive) hydraulic system or an adjustment of the basic speed (rotational speed) of the press to match the time required for movement of the piston/cylinder system. In the press according to the invention, the speed of the upper punch drive unit can be considerably reduced or even temporarily held at zero in the region of the top dead center without any problems, until the compact has been released. As a result, a hydraulic outlay on the cylinder movements required for the loading force can be kept very low. After demolding, the upper punch drive unit can be returned to its starting position at the maximum possible speed.

Advantageous operation of the press according to the invention is also produced if the stroke in the region of the bottom dead center of the upper punch unit is set in such a way that the bottom dead center is overrun slightly. The press is therefore operated in the region of a crank angle which is slightly above 180° (absolute angle). After the end point has been reached, the fundamentally reversing operation of the press means that the dead center is inevitably crossed again at 180°. This means that double pressing with the maximum compressive force at the bottom dead center is carried out for each working cycle in an extremely simple way. For certain pressed parts, this is particularly advantageous.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
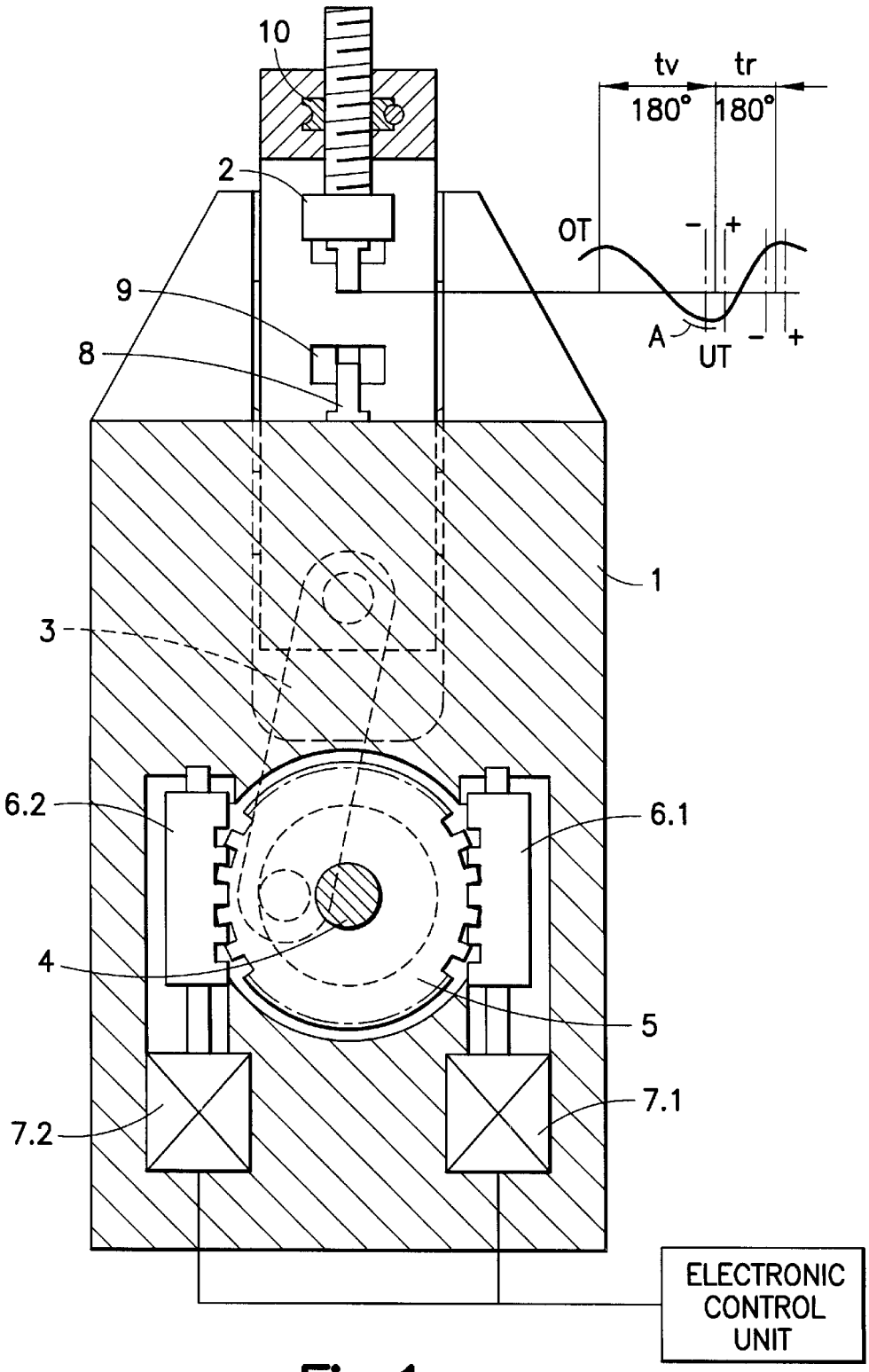
FIG. 1 shows a diagrammatic cross section through a press according to the invention.

The illustration shown in FIG. 1 is a diagrammatic representation of a press according to the invention in section, with only the drive for an upper punch unit 2 (i.e. the upper ram of the press, in which the upper punch unit is mounted) illustrated. This upper punch unit 2, in which one or more upper punches are held, depending on the shape of the pressed body to be produced, is mounted in such a manner that it can slide in a machine frame 1 of the press. The pressed body is produced in the mold cavity which is enclosed by a die 9 and a lower punch unit 8 which is, for example, fixedly supported in the machine frame 1 of the press and into which the upper punch(es) penetrate during pressing. Expediently, a mechanical adjustment device 10 is provided, by means of which the starting and end positions of the upper punch unit 2 can be set. The upper punch unit 2 is moved, via a connecting rod 3, by means of a crankshaft 4 which is mounted rotatably in the machine frame 1. When the crankshaft 4 rotates, an approximately sinusoidal speed profile is generated for the upper punch unit 2. A gear wheel 5, which is designed as a worm wheel, is connected to the crankshaft 4 in a rotationally fixed manner. The connecting rod 3 is connected to the crankshaft 4 via an eccentric disc which may be designed integrally with the gear wheel 5. Two worms of two worm drives 6.1, 6.2 which are arranged diametrically opposite one another with respect to the center axis of the crankshaft 4 are arranged to the left and right of the gear wheel 5. The two worms are each driven by a hydraulic motor 7.1, 7.2. An electronic rotation angle transmitter (not shown), which can be used to indirectly detect the current position of the upper punch unit 2, is accommodated on the crankshaft 4. To move the upper punch unit 2, a hydraulic pressure system is provided, which is likewise not shown in more detail and also provides the supply to further hydraulically driven press tool parts (e.g. die, lower punch unit or tool adapter). All the movements of the parts of the press are guided by an electronic control unit that controls the valves and pumps of the hydraulic system on the basis of the measured values from the rotation angle transmitter or the direct measurement systems used.

While the diagrammatic illustration shown in FIG. 1 provides the eccentric crank drive in the lower part of the machine frame 1, in a practical design of a press according to the invention it should be much more advantageous for the eccentric crank drive to be arranged above the upper punch unit 2, i.e. in the tip of the press. This does not change the fundamental way in which it functions.

The way if i which the press according to the invention operates can be described as follows:

The hydraulic medium delivered by a hydraulic pump is applied to the two worms of the worm drives 6.1 and 6.2 via the hydraulic motors 7.1 and 7.2, and these worms apply a torque to the gear wheel 5 in accordance with the gear ratio of the worm n drives 6.1, 6.2 and bring about a corresponding rotary movement of the crankshaft 4. The electronic control unit is designed in such a way that switching the direction of rotation of the hydraulic motors 7.1, 7.2 results in a reversing rotary movement at the crankshaft 4 over an angular range of, for example, 120°. If the number of revolutions of the hydraulic motors 7.1, 7.2 is selected appropriately, the crank drive runs all the way into the region of the bottom dead center. The press control unit may be designed in such a way that, depending on requirements, a press limit position which is beyond the bottom dead center of the connecting rod 3 is reached. In this case, the absolute dead center of the press is crossed once in the actual working cycle and then once again at the start of the "return cycle", resulting in double pressing. Curtailing the rotation of the crankshaft to a range significantly below 180° avoids the need to run all the way through the relatively time-consuming valley and/or the peak of the sinusoidal movement curve. As a result, it is easily possible to save approximately 30–50% of the cycle time. This possibility exists only with reversing operation in the context of the present invention, but not when pressing using the conventional eccentric drive, which regularly executes complete revolutions. Depending on requirements, it is possible, by changing the volumetric flow rate of hydraulic medium due to the considerable torque transmission ratio of the worm drives 6.1, 6.2 and the crank action of the connecting rod 3, to generate a high compressive force at a comparatively moderate speed of the upper punch unit 2, which is favorable for compression of the powder. The movement of the upper punch unit 2 for opening the press mold and releasing the pressed body is brought about by switching over the direction of rotation of the hydraulic motors 7.1, 7.2. By means of suitable valve circuits, the hydraulic motors 7.1, 7.2 may optionally be connected into the hydraulic circuit in a parallel or series arrangement. The former option is recommended in particular for the working cycle (compression), and the latter is especially recommended for the return cycle (demolding of the pressed part). If the delivery flow from the hydraulic pump remains constant, this means that the return cycle takes place with half the force but twice as quickly as the actual working cycle. The press according to the invention therefore advantageously combines a slow working movement with a high compressive force and a rapid return movement with a lower force. In this way, the drive capacity of the press can be utilized considerably more uniformly over the duration of the pressing cycle than with a standard hydraulic press. Naturally, if required, the parallel or series arrangement may also be maintained unchanged throughout the entire pressing cycle; the latter option is recommended in particular in order to achieve a high production rate for pressed parts of relatively low height, for which lower compressive forces are sufficient. In principle, the press according to the invention can also be operated like a standard mechanical press in continuous mode, i.e. without the drive motors being reversed. This still has the advantage that the working speed is easy to adapt. It is expedient to provide an electronic control unit for the press, allowing continuous-path control with freely programmable control positions and speeds.

The top right-hand part of FIG. 1 illustrates the sinusoidal profile of the distance covered by the upper punch unit 2 as a function of time. In the example selected, the crankshaft rotation is 180°, the upper punch unit 2 moving from the top dead center OT to the bottom dead center UT. The time required for this movement (compression stroke) is denoted by $t_V$. Since the subsequent return movement from the bottom dead center UT to the top dead center OT is carried out with the hydraulic motors 7.1, 7.2 connected not in a parallel hydraulic circuit, but rather a series hydraulic circuit, although the rotation of the crankshaft 4 remains constant, the time required has decreased owing to the constant delivery rate from the hydraulic pump and is only $t_r$. Therefore, the second part of the sinusoidal curve is correspondingly compressed in the direction of the time axis. Dot-dashed lines and the symbols +/− in the graph indicate that the limit position of the upper punch unit can be varied in the positive or negative direction in the region of the dead center positions. That part of the working cycle in which the powder is being compressed in the press mold is denoted by A.

Figure 2:
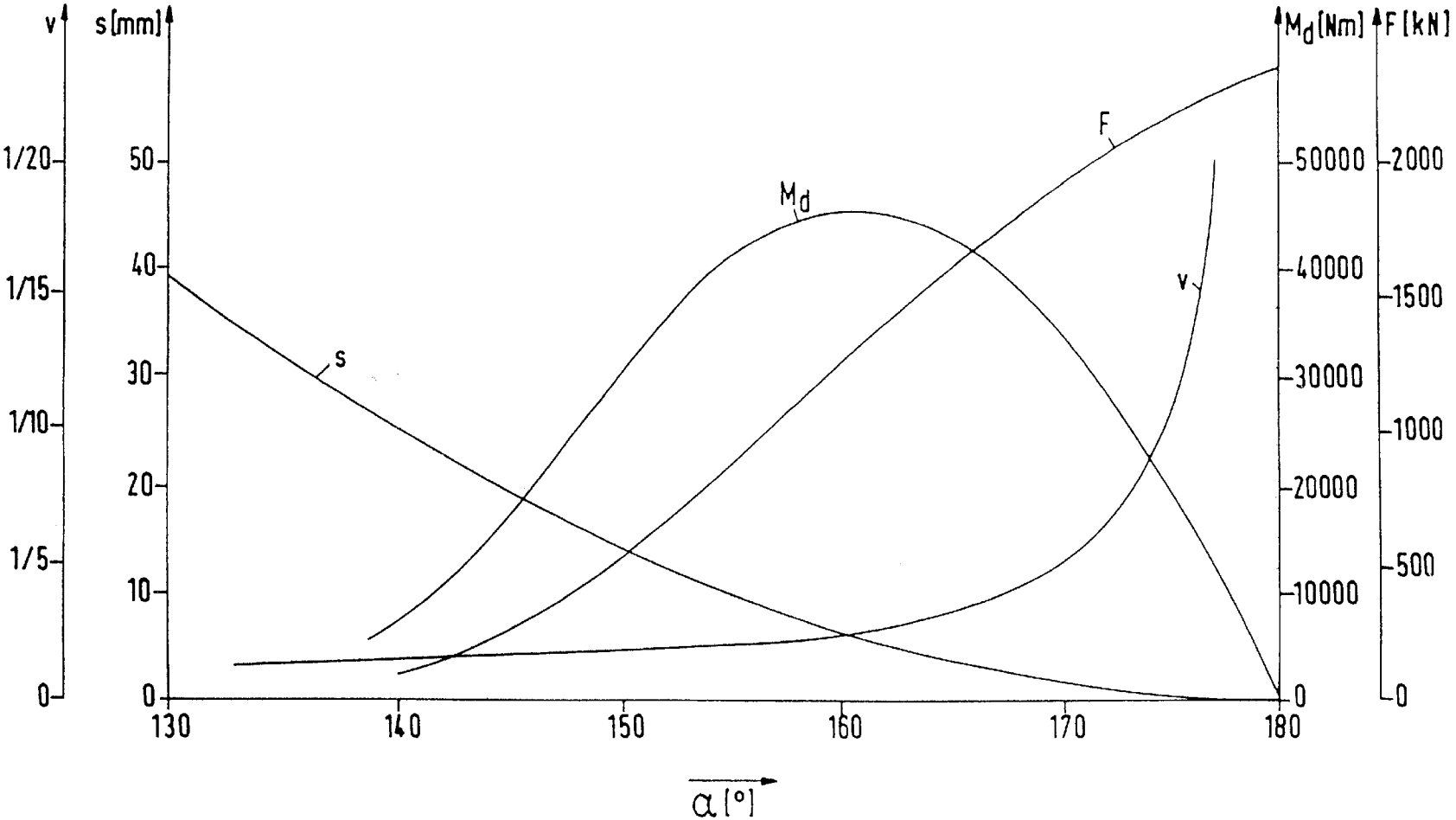
FIG. 2 shows the profile of characteristic parameters of the press as a function of the crank angle.

FIG. 2 illustrates, as an exemplary embodiment, the profiles of a number of characteristic values of a press according to the invention as a function of the crank angle $\alpha$ of the eccentric crank drive. In this figure, only the section in the range of the crank angle $\alpha$ from 130° to approximately 180° (bottom dead center) is shown. The example selected relates to a press in which the crank angle range from 130° to 180° corresponds to a displacement travel of the upper punch unit of around 40 mm. In FIG. 2, the curve s for the displacement travel in FIG. 2 therefore indicates the distance of the upper punch unit from the bottom dead center position. This displacement travel approximately corresponds to the actual pressing operation in the press, that is to say the phase of powder compaction.

The curve denoted by F reproduces the profile of the actual compressive force for a representative pressed body which is of the maximum height which can be processed by the press. As the powder compaction increases, this compressive force F increases considerably beyond a crank angle $\alpha$ of approximately 140°, to a level of 2340 kN in the bottom dead center.

The torque $M_d$ on the crankshaft which is associated with the corresponding compressive force, under the given dimensional conditions of the press, is 7125 Nm at a crank angle of 140°. The torque then rises steeply reaches its maximum, at 45500 Nm, at approximately 160°. At the maximum torque, the compressive force is 1225 kN. After the maximum has been reached, the torque drops rapidly as the crank angle $\alpha$ increases further and, at the bottom dead center, is zero, while the compressive force reaches its highest level. The torque at the crankshaft is directly proportional to the torque of the hydraulic motors and therefore to the hydraulic pressure. It can be seen that the highest torque is present even at a medium compressive force, and for the compressive force to increase further, not only is there no need for any increase in the torque, in fact this torque even falls to zero at the bottom dead center. This force profile is generally typical of powder presses and becomes more pronounced as the height of the pressed parts to be produced increases. By contrast, the profile of the torque curve is typical for a press with an eccentric crank drive. The area below the torque curve $M_d$ is representative of the work performed during compaction of the pressed body.

Under the conditions of the exemplary embodiment on which FIG. 2 is based, the tangential force on the gear wheel 5 at the maximum torque (45500 Nm) is only 364 kN, while the compressive force F which is actually acting on the compact is 1225 kN. This therefore means that at this point of the working cycle, under the given conditions of the press and the powder to be compressed, the force transition in relation to the current compressive force (1225 kN) is 1:3.37, and in relation to the final compressive force (2340 kN) is 1:6.43. The maximum possible force transmission ratio V is likewise illustrated in FIG. 2 as a function of the crank angle $\alpha$. Particularly in the region of the last few degrees before the bottom dead center is reached, there is a strongly progressive rise for the force transmission ratio V. At a crank angle $\alpha$ of 165°, V is 1:3, while at a crank angle of 175° it has already reached 1:10, and at a crank angle of 177.5° it reaches approximately 1:20. These conditions can be put to practical use and implemented during the production of pressed parts with a very short compressive travel. In such a case, to achieve the maximum compressive force of 2340 kN indicated in the above example, a tangential force on the gear wheel of the crank drive of only approximately 116 kN would be required. This would represent only ⅓ of the tangential force of 364 kN required for the pressed body of the above example having a considerable height. Accordingly, to produce correspondingly shallow pressed parts, a drive capacity which has been reduced to only approximately ⅓ of the previous level would be required. The usual working range of a powder press lies between the two above-mentioned extremes of the transmission ratio for the compressive force of approximately 1:6 and approximately 1:20. Compared to the press according to the invention, a standard hydraulic press with a direct piston drive for the press tools, even with an intelligent load-dependent and speed-dependent control unit, would still have a power requirement which is three times higher.

With regard to the flexibility of.the press according to the invention, it should also be noted that by changing the delivery capacity at the hydraulic pump, it is possible, without problems, to directly change the basic speed of the press and the speeds within individual sections of the cycle. The control outlay required for this purpose is minimal. By suitably switching the hydraulic valves, it is possible, if necessary, to incorporate standstill times into the press cycle or alternatively to shorten the time required for return strokes.

The drive which is proposed by the invention is particularly advantageously used for the upper punch unit in powder presses whose other movement planes (die, tool adapter) are likewise hydraulically driven and which have a common principal drive motor for the hydraulics. This is particularly expedient because the power necessary for the upper punch unit and the die is generally not required simultaneously, but rather in succession, and the greater flywheel effect of a central drive is expedient for reducing the peak power at the upper punch unit in the region of a crank angle of approximately 160° and subsequently at the bottom dead center (crank angle 180°) when the die is pulled off. The press according to the invention provides a sinusoidal movement and force profile, allows a high level of accuracy to be achieved for the pressed bodies to be produced, is highly efficient, is extremely flexible with regard to the parts which can be produced, significantly increases production capacity and represents significant progress in manufacturing technology.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

We claim:

1. A press for pressing pulverulent materials, comprising: an upper punch unit; an eccentric crank drive for driving the upper punch unit, the crank drive having a crankshaft, a gearwheel connected to the crankshaft in a rotationally fixed manner, and a connecting rod connected between the upper punch unit and the crankshaft; two hydraulic motors each having a worm drive drivingly engaged with the gearwheel; and an electronic control unit operatively connected to the eccentric crank drive for reversing operation of the crankshaft so that a stroke of the upper punch unit is reversed shortly before each instance of reaching at least one of top dead center and be bottom dead center of the eccentric crank drive, the electronic control unit being operative to connect the two hydraulic motors selectively in parallel and in series in terms of how the motors are supplied with hydraulic medium.

2. A press as defined in claim 1, wherein the control unit is operative to control rotation of the crankshaft during a working stroke and a return stroke so that the crankshaft is rotated through an angular range of less than 180°.

3. A press as defined in claim 1, wherein the electronic control unit is operative to control the eccentric crank drive so that a bottom dead center of the eccentric crank drive is slightly overrun in order to reach a press limit position corresponding to an end of a working stroke.

4. A press for pressing pulverulent materials, comprising: an upper punch unit; an eccentric crank drive for driving the upper punch unit, the crank drive having a crankshaft, a gearwheel connected to the crankshaft in a rotationally fixed manner, and a connecting rod connected between the upper punch unit and the crankshaft; two hydraulic motors each having a worm drive drivingly engaged with the gearwheel; and an electronic control unit operatively connected to the eccentric crank drive for reversing operation of the crankshaft so that the upper punch unit has a stroke whereby a bottom dead center of the eccentric crank drive is overrun slightly.

* * * * *